US006988953B2

(12) United States Patent
Kuoppa et al.

(10) Patent No.: US 6,988,953 B2
(45) Date of Patent: Jan. 24, 2006

(54) OBSTACLE ON A BOWLING LANE

(75) Inventors: Pentti Kuoppa, Toijala (FI); Mikko Sievänen, Tampere (FI)

(73) Assignee: System-300 Group Oy, Tampere (FI)

( * ) Notice: Subject to any disclaimer, the term of this patent is extended or adjusted under 35 U.S.C. 154(b) by 0 days.

(21) Appl. No.: 10/416,810

(22) PCT Filed: Nov. 13, 2001

(86) PCT No.: PCT/FI01/00981

§ 371 (c)(1),
(2), (4) Date: Oct. 22, 2003

(87) PCT Pub. No.: WO02/40117

PCT Pub. Date: May 23, 2002

(65) Prior Publication Data

US 2004/0048678 A1 Mar. 11, 2004

(30) Foreign Application Priority Data

Nov. 14, 2000 (FI) ..... 20002489

(51) Int. Cl.
*A63D 5/00* (2006.01)

(52) U.S. Cl. ..... 473/113

(58) Field of Classification Search ..... 473/110, 473/113, 115
See application file for complete search history.

(56) References Cited

U.S. PATENT DOCUMENTS

| | | | | |
|---|---|---|---|---|
| 3,313,262 | A * | 4/1967 | Yunker et al. | 114/287 |
| 3,401,933 | A * | 9/1968 | Conklin et al. | 473/109 |
| 4,330,122 | A | 5/1982 | Sheinberg et al. | |
| 4,967,682 | A * | 11/1990 | O'Donnell | 114/286 |
| 5,152,545 | A * | 10/1992 | Hupperts et al. | 280/463 |
| 5,154,418 | A | 10/1992 | Wortman | |
| 5,181,716 | A | 1/1993 | Stephens | |
| 5,297,998 | A | 3/1994 | Greiner | |
| 5,304,097 | A | 4/1994 | Duff | |
| 5,322,476 | A * | 6/1994 | Wortman | 473/113 |
| 5,380,251 | A | 1/1995 | Heddon | |
| 5,415,591 | A | 5/1995 | Beene | |
| 5,417,616 | A | 5/1995 | Widrick | |
| 5,449,326 | A | 9/1995 | File | |
| 5,564,986 | A | 10/1996 | Gretzky et al. | |
| 5,681,224 | A | 10/1997 | Higashi | |
| 5,857,918 | A | 1/1999 | Beene | |
| 6,684,425 | B2 * | 2/2004 | Davis | 5/615 |

* cited by examiner

*Primary Examiner*—William M. Pierce
(74) *Attorney, Agent, or Firm*—Venable LLP; Eric J. Franklin

(57) ABSTRACT

The invention relates to an obstacle on a bowling lane for keeping the bowling ball on a single bowling lane. The obstacle comprises at least one obstacle element which is arranged to be movable and is located next to the edge of a single bowling lane, in the longitudinal direction of the same, means for moving the obstacle element and means for guiding the movement of the obstacle element. The means for moving the obstacle element comprise a channel (5) underneath the obstacle element that can expanded with a gaseous or liquid substance.

9 Claims, 2 Drawing Sheets

OBSTACLE ON A BOWLING LANE

FIELD OF THE INVENTION

The present invention relates to an obstacle on a bowling lane for keeping the bowling ball on a single bowling lane, and to a bowling lane. The obstacle comprises at least one obstacle element that is arranged to be movable and is located next to the longitudinal edge of a single bowling lane, means for moving the obstacle element and means for guiding the movement of the obstacle element. The bowling lane includes

- a substructure,
- at least one single bowling lane comprising an approach lane, a ball track, and a pin deck,
- a gutter travelling on both sides of a single bowling lane, in parallel to the same in the longitudinal direction of the bowling lane,
- an obstacle element that can be moved to an upper and lower position, and is located next to the longitudinal edge of the bowling lane,
- means for moving the obstacle element, and
- means for guiding the movement of the obstacle element.

BACKGROUND OF THE INVENTION

A problem that can occur when an inexperienced bowler is bowling is that the bowling ball leaves the bowling lane and falls to the gutter so often that bowling is no longer inspiring. Therefore, obstacles have been developed for bowling lanes by means of which the falling of the bowling ball from the track to the gutter travelling on the side of the track is prevented. This form of bowling, in which the drifting of the bowling ball into the gutter is prevented, is called bumper bowling in English. There is no established Finnish term for this purpose. Because the Finnish terms related to bowling lanes are otherwise unestablished to a certain extent as well, corresponding English terms are shown in parenthesis in this application.

Usually the falling of the bowling ball into the gutter has been prevented either by moving the edge of the gutter in such a manner that it forms an obstacle for the bowling ball or by moving a separate obstacle located between the bowling lane and the gutter.

Obstacles that are formed in the edge of the bowling lane are disclosed for example in the publications U.S. Pat. Nos. 5,564,986, 5,857,918, 5,681,224, 5,417,616, 5,380,251 and 5,304,097.

Publication U.S. Pat. No. 5,304,097 discloses a lane suitable for conventional bowling or bumper bowling, in which the obstacle is formed by means of compatible beams parallel to the longitudinal or lateral direction of the lane.

The publication U.S. Pat. No. 5,380,251 discloses a fence-like obstacle, which can be lifted up in parallel with the lane by means of beams extending underneath the gutter.

The publication U.S. Pat. No. 5,417,616 discloses an obstacle, which is formed when the other side of a gutter composed of two parts is lifted up by means of a lever arm and a spring.

The publication U.S. Pat. No. 5,564,986 discloses an obstacle, which is formed when the gutter is lifted up by means of a torsion shaft.

The publication U.S. Pat. No. 5,681,224 discloses an obstacle, the movement of which is effected by means of a hydraulic cylinder. The hydraulic cylinder is guided either manually from the control panel of a score keeping device or by means of an electronic control circuit.

The publication U.S. Pat. No. 5,857,918 discloses an obstacle, which is formed when the other side of a gutter composed of two parts is lifted up by means of air cylinders or another electromechanical system. The air cylinders cushion the mechanical stress exerted to the obstacle when the obstacle is lowered down.

SUMMARY OF THE INVENTION

The drawbacks of prior art obstacles are for example the complex and expensive structures that are liable to breaking. By means of the obstacle according to the invention it is possible to avoid the above-mentioned problems.

The obstacle and the bowling lane according to the invention are characterized in that the means for moving the obstacle element comprise a channel underneath the obstacle element that can be expanded with a gaseous or liquid medium.

The obstacle according to the invention is simple and cheap, and it endures the blows caused by a bowling ball or another object. It is a special advantage of the present invention that the downward movement of the obstacle, i.e. the movement to a position in which the obstacle normally is during bowling, does not have to be cushioned separately, but cushioning is effected already as a result of the structure of the obstacle.

In the longitudinal direction of a single bowling lane, the lane contains an approach lane, a ball track and a pin deck on which the pins to be bowled down stand erect. On both sides of each single bowling lane there is a gutter, along which the bowling ball travels if it falls out of the track. Furthermore, the lane contains machines which are arranged for example to take care of keeping the scores and lifting the pins up.

The entire bowling lane is composed of sections in the lateral direction in such a manner that there are two gutters between single bowling lanes. Underneath the entire bowling lane there is a substructure. The returning of the ball takes place in the space underneath and/or between the gutters in such a manner that balls of two tracks are returned in the same space. Thus, space for the ball return is required only underneath every other pair of gutters. On top of the substructure, bowling lane panels are mounted by means of a suitable attachment, which bowling lane panels can be several superimposed panel layers or bowling lane elements composed of a multiple layer structure. Between the panel layer or the lane element and the substructure there may be a material, for example a rubber mat or the like, as a cushioning layer.

The substructure of the bowling lane comprises beams extending in the longitudinal direction of the bowling lane, beams extending in the lateral direction of the bowling lane and vertical beams supporting the bowling lane. The beams are connected to each other in such a manner that they form a three-dimensional trussed structure. The substructure may also contain diagonal beams.

The channel according to the invention, which can be expanded with a liquid or gaseous medium, is positioned underneath the obstacle element, extending over the entire distance in the longitudinal direction of a single bowling lane or part of the same that forms the travel path of the bowling ball, i.e. the area between the approach lane and the pin deck. The material of the channel is at least partly flexible in such a manner that it is capable of reacting to a pressure change in the channel. The channel is suitably supported in such a manner that it is substantially parallel to the plane of the bowling lane. Underneath the channel there may be a plate or a groove parallel to the plane of the bowling lane, which supports the channel, or the channel may be attached to the beams in the cross direction of the substructure in such a manner that it does not move in the lateral direction.

BRIEF DESCRIPTION OF THE DRAWINGS

In the following, the invention will be described in more detail with reference to the appended drawings, in which.

DETAILED DESCRIPTION OF THE INVENTION

Figure 1:
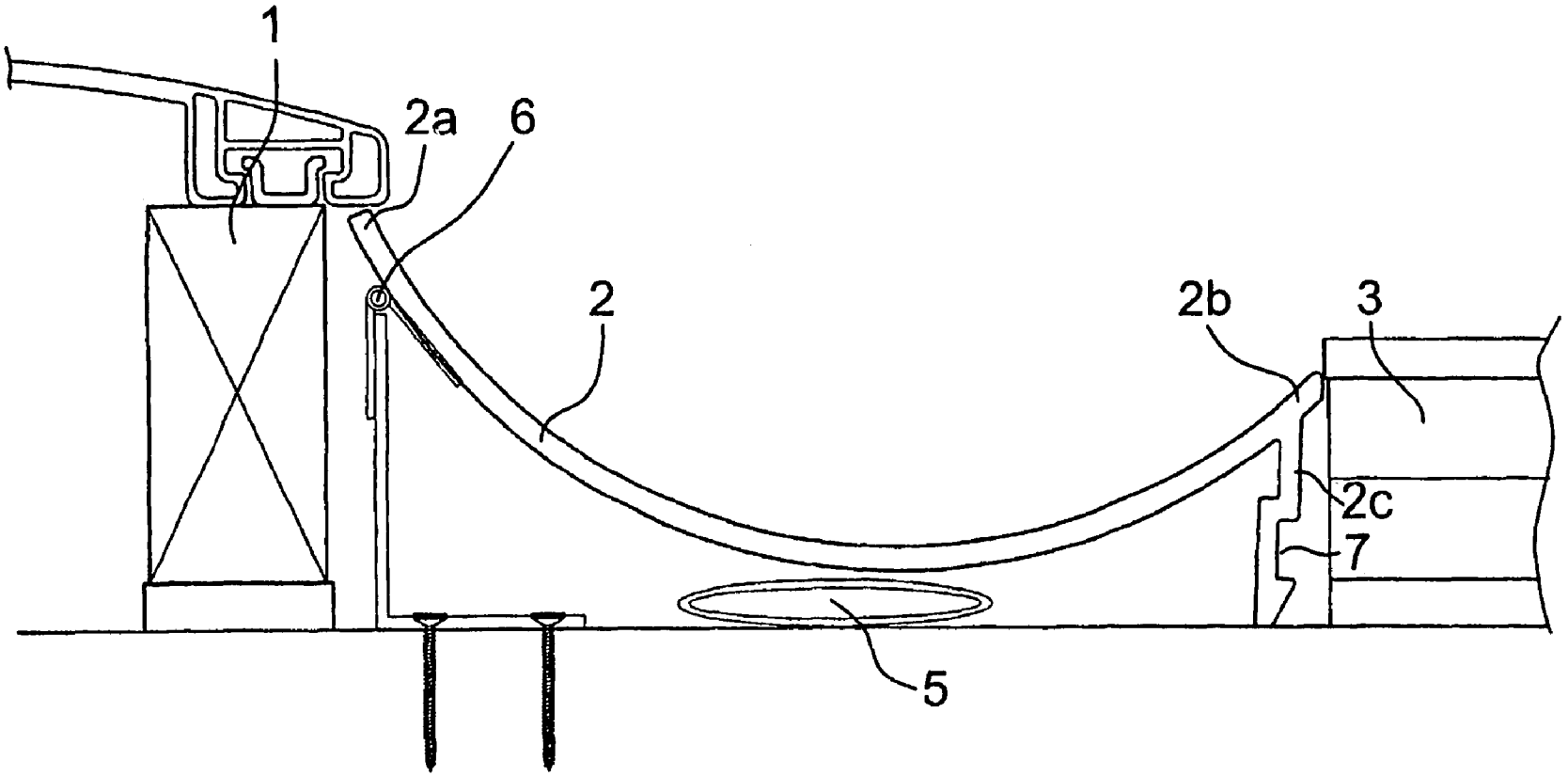
FIG. 1 shows a cross-section of a situation in which the gutter of the bowling lane is in the normal bowling position.
Figure 2:
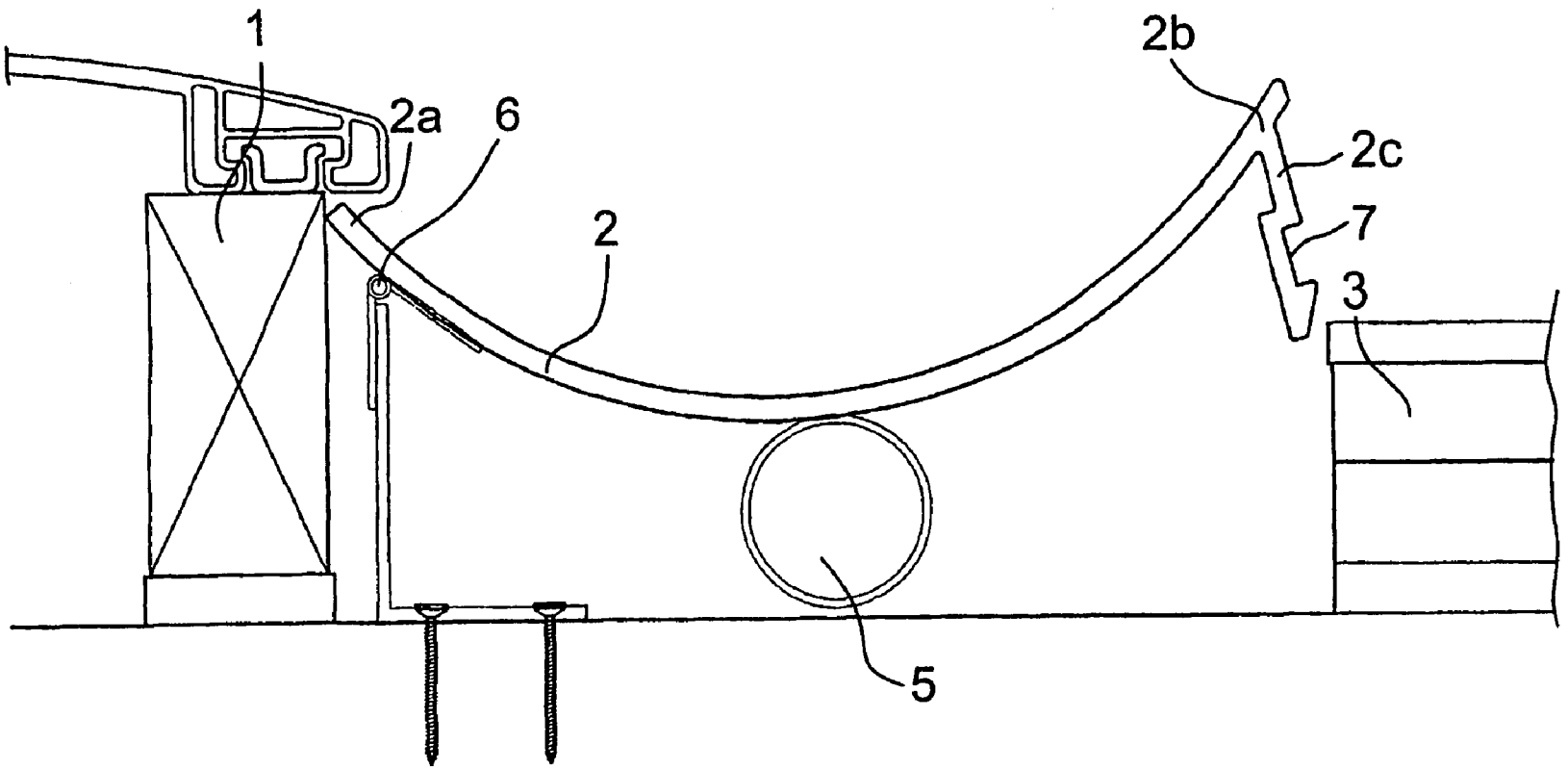
FIG. 2 shows a cross section of a situation in which an obstacle for the bowling balls has been formed from the edge of the gutter of the bowling lane in so-called bumper bowling.

FIGS 1 and 2 show a part of the section of the bowling lane 1 that remains between single bowling lanes. Between a single bowling lane 3 and the section 1 remaining between the bowling lanes there is a gutter 2 comprising a concave section between the edges 2*a* and 2*b* and a substantially vertical section 2*c*. The gutter 2 is attached from its other end 2*a* with a turning joint 6 to the L-shaped supporting beam 4 of the gutter. The supporting beam 4 of the gutter, in turn, is attached to the substructure of the bowling lane. By means of the supporting beam 4 it is possible to arrange the adjustments of the gutter in the vertical and lateral direction. The other edge 2*b* of the gutter 2 can be moved and turned freely around a supporting point in such a manner that maintenance or other corresponding work can be conducted in the area underneath the gutter 2. The turning joint may be for example a hinge. Underneath the gutter 2 there is a channel 5 which is made of flexible, pressure-proof and wear-proof material. The shape of the cross-section of the channel 5 can be changed by changing the pressure in the channel 5. Typically, the channel 5 is made of fabric-reinforced polymer material. For example a fabric-reinforced polyvinyl chloride hose, which is conventionally used as a fire hose, is made of a suitable material.

The channel 5 can be placed to a suitable location in the lateral direction of the gutter 2 underneath the same, depending for example on the diameter of the channel and the required lifting height. Suitable lifting height is typically 50 to 60 mm. Instead of one single channel, there may be several channels 5. The channel 5 may also be lifted upwards from the upper surface of the substructure in a suitable manner with a suitable raising or on the lower surface of the gutter 2 there may be a thicker section, wherein the lifting of the gutter 2 can be implemented by means of a channel 5 having a small diameter, or it can be lifted higher than without the above-mentioned raisings or thicker sections. Thus, the channel 5 is in direct contact with the lower surface of the gutter 2 in such a manner that between the same there may be only the above-mentioned raisings and/or thicker sections.

When the aim is to lift up the edge of the gutter so that it forms an obstacle for the bowling balls, in other words to an upper position, the channel is arranged to be filled with a suitable liquid medium such as water, or gaseous medium, such as air. The preferred medium is air. The air pressure in the channel 5 is advantageously 400 to 1000 Pa higher than the pressure of the air surrounding the channel, most advantageously 400 to 500 Pa higher than the pressure of air surrounding the channel. The pressure is generated by means of a compressor or a blower.

When there is a need to lower the gutter down to the normal position used during bowling, in other words to the lower position, air is removed from the channel 5. The air is removed from the channel 5 in such a manner that an air bleeding valve connected to the channel 5 is arranged to open when it receives a signal from the control unit. The filling and emptying of the channel 5 can be controlled with a simple on/off switch or by means of computer control, wherein the lifting of the edge of the gutter as an obstacle or lowering of the same from the obstacle position can be connected for example to the automatic scoring system of the bowling lane. Thus, it is possible to input information on the players in a computer, and when such a bowler has his/her turn who needs the obstacles on the sides of a single bowling lane, the edge 2*b* of the gutter 2 is arranged to be lifted up automatically for this player. The edge 2*b* of the gutter 2 is automatically lowered down when a bowler who bowls in the conventional way has his/her turn. When the edge of the gutter is lowered down, the channel 5 becomes empty and a sound caused by discharge of air is attenuated by means of sound attenuators installed in the air bleeding valves. The emptying of the channel 5 is arranged so that it takes place sufficiently slowly, irrespective of the manner of control, for example with the dimensioning of the air bleeding valve in such a way that the edge 2*b* of the gutter 2 is lowered down in a cushioned manner, in other words it does not fall down suddenly. Sudden falling might cause damages in the gutter as well as disturbing noises resulting from the falling. When the channel has become sufficiently empty, the substantially vertical section 2*c* of the gutter 2 remains on top of the substructure. The channel 5 is also a suitably flexible base for the gutter 2 when the bowling ball hits the edge of the gutter and causes vibration of the gutter.

If desired, it is possible to install devices giving visual effects in the groove 7 extending throughout the entire length of the gutter 2, which effects become visible when the gutter 2 has been lifted up. Such devices giving visual effects may be for example bands of optical cable.

The above-described facts do not restrict the invention, but the invention may vary within the scope of the claims. The invention can also be applied in lanes of other pin games, for example in so-called Kegel lanes. The obstacle element does not necessarily have to be the edge of the gutter, but it can be a separate element between the bowling lane and the gutter, which is lifted up and lowered down by means of a channel located under the same that can be expanded with a gaseous or liquid medium. Furthermore, the obstacle element can be the edge of the gutter in such a manner that the entire gutter is lifted up in the vertical direction for example by means of two channels. It is also possible that between the obstacle element and the channel there is a passive connecting element that transmits the movement of the channel and effects the movement of the obstacle element.

The function of the channel to lift up the obstacle element does not necessarily have to be based on the fact that the pressure of the channel in the lower position is substantially the same as the pressure of the ambient air, but the function of the channel can also be based on the difference between the pressures prevailing in the upper and lower positions. Thus, the pressure in the channel can be higher than normal air pressure at all times. The cross-section of the channel is not necessarily circular, but the shape of the same may vary. The cross-sectional area of the channel may vary for example in such a manner that at the point where the obstacle element is lifted up the cross-sectional area of the channel is larger than in other sections of the channel. It is an essential aspect of the present invention that with the so-called bumper bowling in mind, the obstacle for preventing the falling of the bowling ball in the gutter can be formed in a simple manner by using a stationary channel, the filling and emptying of which causes the movement of the obstacle element.

The invention claimed is:

1. A bowling lane, comprising:

a lane portion;

a gutter extending along each side of the lane portion, the gutter being movable between a stowed position and deployed position, wherein in the deployed position the gutter acts as an obstacle operative to maintain a bowling ball on the lane portion;

a turning joint operative to move the gutter between the stowed position and the deployed position; and at least one moving member operative to move the gutter between the deployed position and the stowed position, the at least one moving member comprising at least one channel located underneath the gutter, wherein the at least one channel is operative to expanded by an expanding medium.

2. The obstacle according to claim 1, wherein the at least one channel and the gutter directly contact each other.

3. The obstacle according to claim 1, wherein the turning joint comprises a hinge.

4. The obstacle according to claim 1, wherein the at least one channel comprises a flexible hose.

5. The obstacle according to claim 1, wherein the at least one obstacle element is in an upper position when the at least one channel has been filled with the expanding medium.

6. The obstacle according to claim 1, wherein the expanding medium is gaseous.

7. The obstacle according to claim 1, wherein the expanding medium is liquid.

8. The gutter according to claim 1, wherein the obstacle is in a lower position when the at least one channel is at least partially emptied of the expanding medium.

9. The obstacle according to claim 1, wherein the gutter is operative to move perpendicularly to a plane of the bowling lane.

* * * * *